US005246825A

United States Patent [19]

Herz et al.

[11] Patent Number: 5,246,825

[45] Date of Patent: Sep. 21, 1993

[54] PREPARATION OF PHOTOSENSITIVE SILVER HALIDE MATERIALS WITH ORGANIC RIPENING AGENTS

[75] Inventors: Arthur H. Herz; Roger L. Klaus, both of Rochester, N.Y.

[73] Assignee: Eastman Kodak Company, Rochester, N.Y.

[21] Appl. No.: 880,619

[22] Filed: May 8, 1992

[51] Int. Cl.[5] ..... G03C 1/005

[52] U.S. Cl. ..... 430/569; 430/567

[58] Field of Search ..... 430/567, 569, 611

[56] References Cited

U.S. PATENT DOCUMENTS

| | | | |
|---|---|---|---|
| 2,839,405 | 6/1958 | Jones | 430/608 |
| 3,271,157 | 9/1966 | McBride | 430/599 |
| 3,536,487 | 10/1970 | Graham | 430/611 |
| 3,574,628 | 4/1971 | Jones | 430/567 |
| 3,598,598 | 8/1971 | Herz | 430/607 |
| 4,378,424 | 3/1983 | Altland et al. | 430/611 |
| 4,631,253 | 12/1986 | Mifune et al. | 430/569 |
| 4,665,017 | 5/1987 | Mifune et al. | 430/569 |
| 4,675,276 | 6/1987 | Nakamura et al. | 430/614 |
| 4,695,534 | 9/1987 | Bryan et al. | 430/569 |
| 4,695,535 | 9/1987 | Bryan et al. | 430/569 |
| 4,713,322 | 12/1987 | Bryan et al. | 430/569 |
| 4,749,646 | 6/1988 | Herz et al. | 430/569 |
| 4,782,013 | 11/1988 | Herz et al. | 430/564 |
| 4,865,965 | 9/1989 | Friour et al. | 430/569 |
| 5,004,679 | 4/1991 | Mifune et al. | 430/569 |
| 5,028,522 | 7/1991 | Kojima et al. | 430/603 |

FOREIGN PATENT DOCUMENTS

| | | |
|---|---|---|
| 0350903 | 1/1990 | European Pat. Off. . |
| 57-202531 | 12/1982 | Japan . |
| 1586412 | 3/1981 | United Kingdom . |

*Primary Examiner*—Charles L. Bowers, Jr.
*Assistant Examiner*—Mark F. Huff
*Attorney, Agent, or Firm*—Nixon, Hargrave, Devans & Doyle

[57] ABSTRACT

Photosensitive silver halide emulsions are prepared by providing an emulsion containing an anionic acid-substituted organic ripening agent and a salt of an element in Group IIA of the Periodic Table and then growing silver halide grains in the emulsion. This combination of an acid-substituted organic ripener and a salt of a Group IIA element produces a superadditive effect on the growth of silver halide crystals.

19 Claims, No Drawings

PREPARATION OF PHOTOSENSITIVE SILVER HALIDE MATERIALS WITH ORGANIC RIPENING AGENTS

FIELD OF THE INVENTION

The present invention relates to the preparation of photosensitive silver halide emulsions and elements with supports bearing such emulsions.

BACKGROUND OF THE INVENTION

The preparation of photographic emulsions begins with the formulation of a dispersion of microcrystals of silver halide in a protective dispersing medium. Subsequent to or concurrent with the formation of these microcrystals, a silver halide solvent is introduced to permit dissolution, recrystallization, and growth of the individual silver halide particles to a desired crystal (grain) size. This process is known as physical ripening and is typically carried out to increase the size of the silver halide crystals, because photographic sensitivity increases with increasing grain size. A wide variety of chemical substances function as solvents for silver halides; many are listed in T. H. James, ed., *The Theory of the Photographic Process*, 4th ed., Macmillan, N.Y., 1977, p. 9. Silver halide solvents are also known as Ostwald ripeners, ripening agents, crystal growth modifiers, fixing agents, and growth accelerators.

In addition to enhancing silver halide crystal size, recrystallization reactions by ripening agents at apparently fixed crystal dimensions are also known to modify silver halide morphology, to alter the concentration of crystal defects, and to promote the incorporation in the silver halide crystal lattice of sensitizing species such as silver or silver sulfide clusters. These ripener-induced changes tend to increase the photographic sensitivity of silver halide emulsions and since all these changes involve recrystallization phenomena which also participate in silver halide growth, these phenomena are included hereafter in the discussion and claims regarding silver halide growth.

Among the substances reported to be effective ripening agents are excess halide ion and ammonia, as described in G. F. Duffin, *Photographic Emulsion Chemistry*, Focal Press Ltd., London, 1966, pp. 60–62, and thiocyanate ion, as disclosed in U.S. Pat. No. 3,320,069 to Illingsworth. Many organic compounds have also been reported to function as ripeners. For example, U.S. Pat. Nos. 3,271,157 to McBride and 3,574,628 to Jones disclose the use of thioether compounds as ripening agents for silver halide photographic materials. U.S. Pat. No. 4,782,013 to Herz et al. discloses the use of macrocyclic ether compounds containing oxygen, sulfur, and selenium atoms for this purpose.

Silver halide solvents or ripening agents are generally ligands for $Ag^+$ ions that combine with $Ag^+$ ions to form soluble $Ag^+$ adducts or complex ions. Although ripening agents are very useful for controlling the size, dispersity, and morphology of silver halide grains and for determining the location of specific halide components in mixed silver halide compositions, they also cause problems in emulsions during keeping or storage. Specifically, ripeners that are retained in an emulsion after formation and growth of the silver halide grains can change the rates of chemical sensitization, interfere with spectral sensitization, and promote fog formation during storage of emulsions, particularly those coated on a support.

To avoid these undesirable effects, many efforts have been made to remove organic ripeners from emulsions after formation and growth of silver halide grains by purification procedures such as washing. However these ripening agents cannot be completely removed from emulsions even by extensive wash procedures, most likely because of their relatively low aqueous solubility and their affinity for silver halide. U.S. Pat. No. 4,665,017 to Mifune et al. proposes to circumvent this difficulty by deactivating residual ripeners through an oxidation process. This approach, however, has the disadvantage that gelatin in the emulsion also undergoes irreversible changes on oxidation. Furthermore, some ripening agents, e.g., thiourea compounds, upon oxidation yield products of increased activity with respect to desensitization and fog formation.

Another approach to countering the undesirable effect of residual silver halide solvent is the addition of emulsion stabilizers and antifoggants. However, such additives tend to interfere with spectral sensitization and can lead to loss of emulsion sensitivity.

Organic silver halide solvents or ripening agents can be classified into two types: neutral and acid-substituted. A neutral ripening agent is a compound which either is uncharged or carries an equal number of positive and negative ionic charges, i.e., a zwitterionic compound. An acid-substituted ripening agent is a compound that incorporates a covalently bonded acidic function which, upon deprotonation at about pH 7 or below, confers a negative charge on the molecule. These two classes of ripening agents are exemplified by the neutral compound ethanolamine and its acid-substituted analog, glycine. Both compounds yield $Ag^+$ complexes of similar stability and are capable of ripening AgBr emulsions. However, in dilute alkaline solution, where its acidic function is deprotonated, glycine dissolves AgBr much more slowly than does the neutral ethanolamine (D. Shiao, L. Fortmiller, and A. Herz, *J. Phys. Chem.*, 1975, 79, 816).

Similarly, U.S. Pat. No. 4,749,646 to Herz et al. discloses that N,N,N',N'-tetramethylthiourea accelerates silver halide grain growth, as measured by equivalent circular diameter, more than its N,N'-dicarboxymethyl-N,N'-dimethylsubstituted analog. On the other hand, the high level of storage fog induced by tetramethylthiourea is somewhat diminished when it is replaced by its N,N'-dicarboxyethyl-N,N'-dimethyl analog.

U.S. Pat. Nos. 4,695,535 to Bryan et al. and 4,865,965 to Friour et al. also disclose acid-substituted ripening agents. The ripeners disclosed in U.S. Pat. No. 4,695,535 are acyclic thioether compounds containing carboxy substituents; the acid-substituted ripening agents disclosed in U.S. Pat. No. 4,865,965 are cyclic ethers.

U.S. Pat. No. 2,839,405 to Jones disclosed addition of salts of inorganic acids following silver halide formation and sensitization.

U.S. Pat. No. 5,028,522 to Kojima et al. disclosed the inclusion of cadmium, zinc, lead, thallium, iridium, rhodium, and iron salts during silver halide grain formation or physical ripening.

The cited art on ripening agents make it apparent that, when coated under a conventional condition at pH values above about 4.6, acid-substituted ripeners interfere less with dye sensitization and cause less storage fog than their neutral analogs. However, under such pH conditions the acid-substituted ripeners exist substantially in their anionic state and often suffer from the distinct disadvantage of exhibiting low activities as accelerators of silver halide growth. Hence, it is the major purpose of the present invention to overcome this barrier for the convenient application of acid-substituted ripeners in photographic systems as useful promoters of silver halide dissolution, recrystallization and growth by using them in combination with a salt of a Group IIA element.

SUMMARY OF THE INVENTION

The present invention relates to the preparation of a photosensitive silver halide emulsion or a photosensitive element with a support bearing such emulsions. Such products are prepared by providing an emulsion comprising:

an anionic acid-substituted organic ripening agent having the general formula (I) or (II)

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent;

m and n are independently zero or integers from 1 to 6;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more functional groups containing heteroatoms selected from the group consisting of halogen, oxygen, sulfur, and nitrogen atoms;

X is selected from the group consisting of S, Se, and Te; and

Y is selected from the group consisting of O, S, Se, and Te;

a, b, and c are independently 0, 1, or 2, and at least one of a, b, or c is greater than zero;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$; and d, e, f, and g are independently 0 or 1 and at least one of d, e, f, and g is 1; and a salt of an element in Group IIA of the Periodic Table; and growing silver halide grains in the emulsion.

The combination of an anionic acid-substituted organic ripening agent and a salt of an element in Group IIA of the Periodic Table is highly advantageous, because it achieves a superadditive effect on silver halide grain growth without adversely affecting sensitization or inducing fog.

DETAILED DESCRIPTION OF THE INVENTION

Photosensitive silver halide emulsions are prepared by a process comprising:

providing an emulsion comprising:

an anionic acid-substituted organic ripening agent having the general formula (I) or (II)

$$(A)_aR^1[XR^2(A)_b]_m[YR^3(A)_c]_n \quad (I)$$

-continued $$R^4(A)_dR^5(A)_eN-\underset{\underset{Z-R^6(A)_f}{|}}{C}=X \quad (II)$$

wherein each A is independently a covalently bonded acidic substituent;

m and n are independently zero or integers from 1 to 6;

$R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more functional groups containing heteroatoms selected from the group consisting of halogen, oxygen, sulfur, and nitrogen atoms;

X is selected from the group consisting of S, Se, and Te; and

Y is selected from the group consisting of O, S, Se, and Te;

a, b, and c are independently 0, 1, or 2, and at least one of a, b, or c is greater than zero;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$; and d, e, f, and g are independently 0 or 1 and at least one of d, e, f, and g is 1; and a salt of an element in Group IIA of the Periodic Table; and growing silver halide grains in the emulsion.

As previously described, an acid-substituted organic ripening agent contains a covalently bonded acidic function which, upon deprotonation at about pH 7 or below, confers a negative charge on the molecule. The acidic groups on the acid-substituted organic ripeners can, in accordance with the present invention, be selected from the group consisting of —CONHOH, —OPO(OR')OH, —PO(OR')OH, —COOH, $-SO_3H$, $-SO_2H$, $-SeO_3H$, $-SeO_2H$, $-CH(CN)_2$, —SH, $-SO_2SH$, —SeH, $-SO_2SeH$, —CONHCOR, $-CONHSO_2R'$, $-SO_2NHSO_2R'$, and —CR'=NOH, where R' is H or a lower alkyl or aryl group.

The $R^1$, $R^2$, $R^3$, $R^4$, $R^5$, and $R^6$ substituents on the ripening agents are each independently hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen. Particularly useful functional groups are independently selected from the group consisting of —OH, $-COR^9$, $-OR^9$, $-CONHR^9$, $-SO_2NHR^9$, and $-SO_2R^9$, where $R^9$ is a lower hydrocarbon group that is unsubstituted or substituted as described for $R^1$, $R^2$, $R^3$, $R^4$, $R^5$, and $R^6$. $R^1$ can be linked with $R^2$ or $R^3$ to form a cyclic group having fewer than 36 ring atoms. $R^2$ can contain one or more divalent groups or atoms selected from the group consisting of —CO—, —O, $-CONR^8-$, —S(O)—, $-S(O_2)-$, or $SO_2NR^8-$, where $R^8$ is a lower hydrocarbon group that is substituted or unsubstituted as described for $R^1$, $R^2$, $R^3$, $R^4$, $R^5$, and $R^6$. $R^4$ and $R^6$, or $R^4$ and $R^5$ can be linked to form a 5- or 6-membered ring, such as an azole, imidazolidine, thiazolidine, thiazoline, or morpholine.

The $Ag^+$ binding sites contained in the acid-substituted organic ripening agent, or ripener, are not particularly limited. Preferred sites are atoms in Group V of the Periodic Table, preferably nitrogen or phosphorus compounds, exemplified by amines and phosphines, and to atoms in Group VI, in particular sulfur, selenium, and tellurium.

Acid-substituted organic ripeners that are particularly useful for the practice of the present invention belong to the class of ether compounds. This class includes the thioethers of the previously-mentioned U.S. Pat. Nos. 3,271,157, 3,574,628, and 4,695,535 and the macrocyclic ethers of the previously-mentioned U.S. Pat. Nos. 4,782,013 and 4,865,965, the thioethers of U.S. Pat. No. 4,695,534 to Bryan et al., the selenoethers of the previously-mentioned U.S. Pat. No. 5,028,522, and the thio-, seleno-, and telluro-ether compounds disclosed in U.S. Pat. No. 5,004,679 to Mifune et al. and the previously mentioned ethers of U.S. Pat. Nos. 4,695,535 to Bryan et al. and 4,865,965 to Friour et al. which are all hereby incorporated by reference. Other useful ripening agents that may be substituted with acid groups are thiols (mercaptans) and their selenium analogs, i.e. selenols, as well as cyclic and acyclic thionamides, including those of the previously mentioned U.S. Pat. No. 4,749,646 to Herz et al. and of U.S. Pat. Nos. 3,536,487 to Graham, and 3,598,598 to Herz and of British Patent Specifications 1,586,412 to Fuji. Similarly, suitable acid-substituted ripeners and silver halide solvents belonging to the class of triazolium thiolates are discussed in U.S. Pat. No. 4,378,424 to H. Altland et al.; U.S. Pat. No. 4,631,253 to H. Mifune et al.; U.S. Pat. No. 4,675,276 to K. Nakamura et al., which are all hereby incorporated by reference. The acid group of the ripening agents should have a pka of about 1 to about 8, preferably about 3 to 6.

In accordance with the present invention, water-soluble salts of elements in Group IIA of the Periodic Table are also included in the emulsion. Specifically included are salts of barium, calcium, magnesium, and strontium, with the salts of calcium and magnesium being preferred. The salts can be perchlorates, acetates, nitrates, or similarly soluble salts. Particularly preferred for use are calcium or magnesium nitrates.

The combination of an acid-substituted organic ripener and a salt of a Group IIA element can, in accordance with the present invention, be used at any pH below about pH 8, but, preferably, in the range between about 4.6 and 7. The silver halide grains of the emulsion can be modified at temperatures between about 30° to about 90° C., preferably between about 35° to about 70° C. Also, in accordance with the present invention, the concentration of silver halide in the emulsion can be from $10^{-5}$ to 5 mole/liter, preferably $10^{-3}$ to 2 mole/liter. The concentration of acid-substituted organic ripening agent can be from $10^{-6}$ to $10^{-1}$ mole/mole of silver halide, preferably from $10^{-4}$ to $10^{-2}$ mole/mole of silver halide. The concentration of salt of a Group IIA element can be from $10^{-3}$ to 100 mole/mole of acid-substituted organic ripening agent, preferably from 0.5 to 10 mole/mole of acid-substituted organic ripening agent.

Specific examples of acid-substituted organic ripeners that can be used in the present invention are given in Table I.

TABLE I

Acid-Substituted Silver Halide Solvents and Ripeners

| Compound | Structure |
|---|---|
| A1 | $H_2NCH_2COOH$ |
| A2 | 4,5-dicarboxyimidazole |
| A3 | tri(carboxyethyl)phosphine |
| A4 | m-sulfophenyldimethylphosphine |
| A5 | $Te(CH_2COOH)_2$ |
| A6 | $Te(CH_2CH_2COOH)_2$ |
| A7 | $HOCH_2CH_2TeCH_2CH_2SO_3H$ |
| A8 | $CH_2(CH_2TeCH_2CH_2CH_2TeCH_2COOH)_2$ |
| A9 | $(CH_2OCH_2CH_2SCH_2CH_2COOH)_2$ |
| A10 | $(CH_2SCH_2COOH)_2$ |
| A11 | $S(CH_2CH_2SCH_2COOH)_2$ |
| A12 | $(CH_2SCH_2CH_2SCH_2COOH)_2$ |
| A13 | $O(CH_2CH_2OCH_2CH_2SCH_2CH_2SCH_2CH_2COOH)_2$ |
| A14 | $(CH_2OCH_2CH_2SCH_2CH_2SCH_2CH_2COOH)_2$ |
| A15 | $O(CH_2CH_2SCH_2CH_2COOH)_2$ |
| A16 | 1,10-dithia-4,7,13,16-tetraoxacyclooctadecane-5-carboxylic acid |
| A17 | 1,10-dithia-4,7,13,16-tetraoxacyclooctadecane-5-methyleneoxyacetic acid |
| A18 | $[HOOC(CH_2)_3]N(CH_3)CSN(CH_3)[(CH_2)_3COOH]$ |
| A19 | 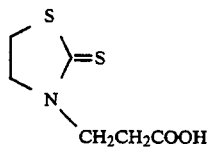 |
| A20 | 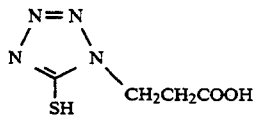 |
| A21 | 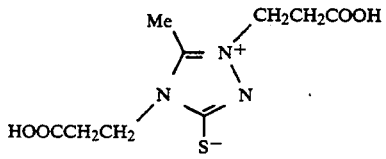 |
| A22 | 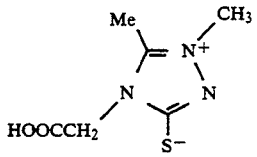 |
| A23 | 1,10-diselena-4,7,13,16-tetraoxacyclooctadecane-5-carboxylic acid |
| A24 | $(CH_2OCH_2CH_2SeCH_2CH_2COOH)_2$ |
| A25 | $(CH_2OCH_2CH_2SeCH_2CH_2CONHCH_2COOH)_2$ |
| A26 | $(CH_2CH_2—SO—CH_2CH_2SeCH_2CH_2COOH)_2$ |
| A27 | $(CH_2OCH_2CH_2SeCH_2CH_2CH_2COOH)_2$ |
| A28 | $O(CH_2CH_2CH_2SeCH_2CH_2COOH)_2$ |
| A29 | $O(CH_2CH_2CH_2SeCH_2CH_2CH_2SeCH_2CH_2COOH)_2$ |
| A30 | 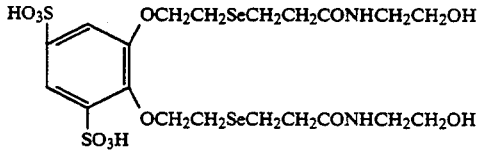 |
| A31 | 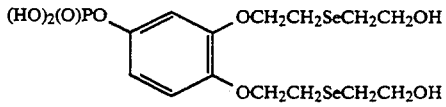 |

TABLE I-continued

| Acid-Substituted Silver Halide Solvents and Ripeners | |
|---|---|
| Compound | Structure |
| A32 | 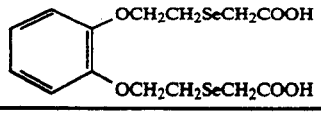 $OCH_2CH_2SeCH_2COOH$ <br> $OCH_2CH_2SeCH_2COOH$ |

In accordance with the present invention, the combination of acid-substituted organic ripening agent and salt of a Group IIA element can be added to a solution of the dispersion medium, e.g., gelatin, at any stage before, during or after formation and chemical or physical ripening of the silver halide emulsion. These compounds can be added simultaneously or singly in any order. The procedure for growing silver halide grains with the combination of a Group IIA salt and acid-substituted organic ripeners can be accomplished by any of the processes generally known in the art and can be achieved at any step of emulsion formation, preparation and sensitization. The process includes growth of silver halide emulsions which were formed in the absence of any ripener where, after completion of silver halide formation, the ripener combination is added to the emulsion which, optionally, may contain other additives such as sensitizers of the spectral or chemical type, or growth-modifying agents such as azaindenes or thiol compounds, or a combination of organic or inorganic ripeners in addition to the acid-substituted ripener and Group IIA salt of this invention. Also included are the art-recognized single jet and multi-jet procedures for silver halide formation; among the latter, the double jet technique is preferred, and the combination of an acid-substituted ripener with a Group IIA salt can be introduced singly or jointly at any stage when this technique is used.

The silver halide emulsions grown and sensitized by the process of the present invention can be silver chlorides, silver iodides or silver bromides of any crystal habit or shape, including tabular and needle forms. The silver halides can also consist of mixed halide compositions, e.g. bromoiodides or chloride-rich compositions containing at least 50 mole % silver chloride. In mixed halide compositions, the various silver halides can be randomly distributed throughout the crystal or their location can be specified, for example, an emulsion having a silver chloride core and an 8 mole % silver bromide shell with a surface layer of silver iodide not exceeding 1 mole %. The process of the present invention can be carried out at any suitable temperature at pH values ranging between about pH 1 and about pH 8, the preferred range being between about pH 4.6 and about pH 7; particularly preferred pH values fall in the range between about pH 5.3 and pH 6.7. The formation and growth of the silver halide emulsion according to this invention can be accomplished with either excess silver ions or excess halide ions, but the preferred condition for growth involves 0 to about 500 mM excess halide ions, preferably between about 0.001 and 50 mM excess halide. Emulsion purification procedures before coating are optional, and gelatin is the preferred colloid and vehicle for the photosensitive silver halide emulsion of the present invention. Other vehicles are disclosed in Section IX of *Research Disclosure*, Item 308119, December 1989, hereinafter referred to as *Research Disclosure*, hereby incorporated by reference.

The emulsions of the present invention can contain ionic antifogging agents and stabilizers such as thiols, thiazolium compounds exemplified by benzothiazolium salts and their selenium and tellurium analogs, thiosulfonate salts, azaindenes and azoles. Also included among these antifoggants and stabilizers are compound classes which, depending on their substituents, may either be ionic or non-ionic; these classes include disulfides, diselenides and thionamides. Also specifically included are non-ionic antifoggants and stabilizers such as the hydroxycarboxylic acid derivatives of W. Humphlett in U.S. Pat. No. 3,396,028 and the polyhydroxyalkyl compounds of U.S. Pat. Application Ser. No. 493,598 entitled "Stabilization of Photographic Recording Materials" to Lok and Herz. Other such agents are disclosed in Section VI of *Research Disclosure*, hereby incorporated by reference.

The emulsions of the present invention can contain chemical sensitizers such as those based on sulfur, selenium, silver or gold, or combinations of such sensitizers. Other sensitizing agents are disclosed in Section III of *Research Disclosure*.

The photographic emulsions of the present invention can be spectrally sensitized with dyes such as cyanines, merocyanines, or other dyes shown in Section IV of *Research Disclosure*, hereby incorporated by reference.

The photographic emulsions of the present invention can contain color image forming couplers, i.e., compounds capable of reacting with an oxidation product of a primary amine color developing agent to form a dye. They can also contain colored couplers for color correction or development inhibitor-releasing (DIR) couplers. Suitable couplers for the practice of the present invention are set forth in Section VII of *Research Disclosure*, hereby incorporated by reference.

The photographic emulsions of the present invention can be coated on various supports, preferably flexible polymeric films. Other supports are disclosed in Section XVII of *Research Disclosure*, hereby incorporated by reference.

Emulsions of the present invention can be applied to a multilayer multicolor photographic material comprising a support on which is coated at least two layers having different spectral sensitivities. Such multilayer multicolor photographic materials usually contain at least one red-sensitive emulsion layer, at least one green-sensitive emulsion layer, and at least one blue-sensitive emulsion layer. The order of these layers can be optionally selected as desired. Usually a cyan-forming coupler is associated with the red-sensitive layer, a magenta-forming coupler is associated with the green-sensitive layer, and a yellow-forming coupler is associated with the blue-sensitive layer.

The photographic emulsions of the present invention can be processed with black and white developing agents such as hydroquinones, 3-pyrazolidones, or other compounds such as those disclosed in Section XX of *Research Disclosure*, hereby incorporated by reference. Primary aromatic amine color developing agents (e.g., 4-amino-N-ethyl-N-hydroxyethylaniline or 3-methyl-4-amino-N,N-diethylaniline) can also be employed. Other suitable color developing agents are described in L.F.A. Mason, *Photographic Processing Chemistry*, Focal Press, 1966, pp. 226–229, and in U.S. Pat. Nos. 2,193,015 and 2,592,364.

Photographic emulsions of the present invention can be applied to many different silver halide photographic materials such as, high speed black and white films, X-ray films, and multilayer color negative films, including those having diffusion transfer applications.

As demonstrated by the following examples, the combination of an acid-substituted organic ripening agent and a salt of a Group IIA element achieves a superadditive effect on silver halide growth. In addition, the combination of an acid-substituted organic ripening agent and a salt of a Group IIA element requires no subsequent removal or chemical deactivation of these materials, because they cause no deleterious effects such as, desensitization or fog formation during subsequent sensitizing of the emulsion, or during its storage and coating. Therefore, this process involves a significant advance in the art.

EXAMPLES

EXAMPLE 1

Ostwald ripening rates of small-particle silver halide emulsions were determined, using Rayleigh light scatter measurements. Details of the measurement method are set forth in A. L. Smith, ed., *Particle Growth in Suspensions*, Academic Press, London, 1973, pp. 159–178. At a temperature of 25° C. and a pH of 6, 8 mM AgBr emulsions of about 50 nm initial diameter dispersed in 0.1% ossein gelatin (isoelectric point 4.9) containing 30 volume percent methanol and 20–28 mM $KNO_3$ in 1 mM KBr (pBr 3) were mixed with organic ripening agents and with calcium nitrate, singly and in combination with one another. Turbidity changes as a function of time, corresponding to AgBr growth rates, were measured at 436 nm. Growth rates were normalized with respect to the rate obtained in the absence of added organic ripening agents or calcium nitrate. Measurements were reproducible within ±15%. The following results were obtained:

| Test | Ripener (conc. in mM) | | mM $Ca(NO_3)_2$ | Relative AgBr growth rate |
|---|---|---|---|---|
| 1 | None | | 0 | 1 |
| 2 | None | | 0.3 | 1.1 |
| 3 | None | | .5 | 1.1 |
| 4 | $(CH_2OCH_2CH_2SCH_2CH_2OH)_2$ | (0.03) | 0 | 5.4 |
| 5 | $(CH_2OCH_2CH_2SCH_2CH_2COOH)_2$ | (0.5) | 0 | 3.4 |
| 6 | $(CH_2OCH_2CH_2SCH_2CH_2OH)_2$ | (0.03) | 0.3 | 4.4 |
| 7 | $(CH_2OCH_2CH_2SCH_2CH_2COOH)_2$ | (0.5) | 0.5 | 5.5 |

Addition of varying amounts of calcium nitrate alone had little effect on AgBr growth rate (compare Tests 2 and 3 with Test 1). Inclusion of a neutral thioether ripener alone at a concentration of 0.03 mM resulted in a greater than five-fold increase in growth rate (Test 4). A structurally similar acid-substituted thioether ripener, on the other hand, gave only an approximate three-fold growth rate enhancement, even though present at a much higher concentration, 0.5 mM (Test 5). The combination of calcium nitrate with the neutral organic ripener used in Test 4 produced a lower relative growth rate than the ripener used alone (Test 6). However, calcium nitrate used in combination with the acid-substituted organic ripening agent employed in Test 5 produced a superadditive effect on the growth of AgBr, as shown by the relative growth rate of 5.5 (Test 7). This result demonstrates the advantageous ripening activity of a combination of an acid-substituted organic ripening agent and a salt of a Group IIA element.

EXAMPLE 2

Small-particle silver halide emulsions were mixed with alkaline earth salts, either alone or in combination with the acid-substituted thioether ripening agent $(CH_2SCH_2COOH)_2$. Relative AgBr growth rates were determined as in Example 1. The results were as follows:

| Test | Salt (conc. in mM) | | mM Acid-substituted Ripener | Relative AgBr growth rate |
|---|---|---|---|---|
| 1 | 0 | | 0 | 1 |
| 2 | $Mg(NO_3)_2$ | (30) | 0 | 1 |
| 3 | $Ca(NO_3)_2$ | (30) | 0 | 1 |
| 4 | 0 | | 3 | 2.4 |
| 5 | $Mg(NO_3)_2$ | (30) | 3 | 36 |
| 6 | $Ca(NO_3)_2$ | (1.5) | 3 | 7 |
| 7 | $Ca(NO_3)_2$ | (3) | 3 | 15 |
| 8 | $Ca(NO_3)_2$ | (30) | 3 | 152 |

Addition of varying amounts of calcium nitrate alone had no significant effect on AgBr growth rate (compare Tests 2 and 3 with Test 1). Mixing the emulsion with the above described acid-substituted thioether ripening agent above at a 3 mM concentration gave a 2.4-fold increase in relative growth rate (Test 4). The combination of this ripening agent at 3 mM concentration with 30 mM magnesium nitrate (Test 5) produced a 36-fold increase in growth rate compared to the emulsion containing no alkaline earth salt or ripener (Test 1). Combinations of the same acid-substituted organic ripening agent at 3 mM concentration with calcium nitrate at a series of concentrations—1.5, 3, and 30 mM—caused increased relative growth rates, from 7, 15, and 152, respectively (Tests 6, 7, and 8, respectively). Thus, very large enhancements in AgBr growth rates (i.e. as much as 60-fold compared with using the ripener alone) were obtained, in accordance with the present invention, using a combination of a salt of a Group IIA element and an acid-substituted organic ripening agent.

EXAMPLE 3

Aliquots of a AgBr emulsion, as described in Example 1, were mixed with calcium nitrate and the acid-substituted selenoether ripening agent $(CH_2OCH_2CH_2SeCH_2CH_2COOH)_2$, singly and in combination with one another, and ripened at 25° C., pH 6.8, and pBr 3 for 5 hours. The reactions were then quenched by the addition of N-ethyl-N'-sulfobutyl-9-methylthiacarbocyanine. The resulting AgBr crystals were analyzed by electronmicrography and crystal sizes, expressed as equivalent circular diameters (ECD) in μm, were determined. The results were as follows:

| Test | mM acid-substituted Ripener | mM $Ca(NO_3)_2$ | AgBr crystal size ECD, μm |
|---|---|---|---|
| 1 | 0 | 0 | 0.022 |
| 2 | 0 | 2.5 | 0.023 |
| 3 | 0.2 | 0 | 0.038 |
| 4 | 0.2 | 2.5 | 0.089 |

Mixing 2.5 mM calcium nitrate alone with the emulsion had no effect on crystal size (compare Tests 1 and 2). Addition of 0.2 mM of the acid-substituted ripening agent alone produced an approximate 70 percent increase in crystal size (Test 3), but the combination of this ripener and calcium nitrate, in accordance with the present invention, gave a size increase of about 400 percent (Test 4).

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. A process of preparing a photosensitive silver halide emulsion comprising:

providing an emulsion containing $10^{-5}$ to 5 mole/liter of silver halide and comprising:

an anionic acid-substituted organic ripening agent present in a concentration of $10^{-6}$ to $10^{-1}$ mole/mole of silver halide and having the general formula (I) or (II)

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent; m and n are independently zero or integers from 1 to 6; $R^1$, $R^2$, $R^3$, $R^4$, $R^5$, and $R^6$ are independently hydrocarbon or fluorocarbon groups having from 1 to 6 carbon atoms, which groups are unsubstituted or substituted with one or more functional groups containing heteroatoms selected from the group consisting of halogen, oxygen, sulfur, and nitrogen atoms;

X is selected from the group consisting of S, Se, and Te; and

Y is selected from the group consisting of O, S, Se, and Te; a, b, and c are independently 0, 1, or 2, and at least one of a, b, or c is greater than zero;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$; and d, e, f, and g are independently 0 or 1 and at least one of d, e, f, and g is 1; and a water-soluble salt of an element in Group IIA of the Periodic Table present in a concentration of $10^{-3}$ to 100 mole/mole of said ripening agent; and growing silver halide grains in the emulsion.

2. A process according to claim 1, wherein $R^1$ is linked with $R^2$ or $R^3$ to form a cyclic group having fewer than 36 ring atoms.

3. A process according to claim 1, wherein m is 2 and each $R^2$ independently contains one or more divalent groups or atoms selected from the group consisting of —CO—, —O—, —$CONR^8$—, —S(O)—, —$S(O_2)$—, or —$SO_2NR^8$—, wherein $R^8$ is a lower hydrocarbon group which may be unsubstituted or substituted as described for $R^1$, $R^2$, $R^3$, $R^4$, $R^5$, and $R^6$.

4. A process according to claim 1, wherein $R^4$ and $R^6$, or $R^4$ and $R^5$ are linked to form a 5- or 6-membered heterocyclic ring, which is unsubstituted or substituted as described for $R^1$, $R^2$, $R^3$ and $R^5$.

5. A process according to claim 4, wherein said heterocyclic ring is selected from the group consisting of an azole, imidazolidine, thiazolidine, thiazoline, and morpholine.

6. A process according to claim 1, wherein said functional groups are independently selected from the group consisting of —OH, —$COR^9$, —$OR^9$, —$CONHR^9$, —$SO_2NHR^9$, and —$SO_2R^9$, wherein, $R^9$ is a lower hydrocarbon group which is unsubstituted or substituted as described for $R^1$, $R^2$, $R^3$, $R^4$, $R^5$, and $R^6$.

7. A process according to claim 1, wherein said acidic substituents are independently selected from the group consisting of —CONHOH, —OPO(OR')OH, —PO(OR')OH, —COOH, —$SO_3H$, —$SO_2H$, —$SeO_3H$, —$SeO_2H$, —$CH(CN)_2$, —SH, —$SO_2SH$, SeH, —$SO_2SeH$, —CONHCOR', —$CONHSO_2R'$, —$SO_2NHSO_2R'$, and CR'=NOH, where R' is H or a lower alkyl or aryl group.

8. A process according to claim 7, wherein said acidic substituents are —COOH groups.

9. A process according to claim 1, wherein the said substituent of said ripening agent has a pKa from about 1 to about 8.

10. A process according to claim 9, wherein the acid substituent of said ripening agent has a pKa from about 3 to about 6.

11. A process according to claim 1, wherein said ripening agent is selected from the group consisting of glycine, 4,5-dicarboxyimidazole, $Te(CH_2COOH)_2$, $(CH_2OCH_2CH_2SCH_2CH_2COOH)_2$, $(CH_2SCH_2COOH)_2$, $(CH_2SCH_2CH_2SCH_2COOH)_2$, $O(CH_2CH_2OCH_2CH_2SCH_2CH_2SCH_2CH_2COOH)_2$, $(CH_2OCH_2CH_2SCH_2CH_2SCH_2CH_2COOH)_2$, $O(CH_2CH_2SCH_2CH_2COOH)_2$, 1,10-dithia-4,7,13,16-tetraoxacyclooctadecane-5-carboxylic acid, 1,10-dithia-4,7,13,16-tetraoxacyclooctadecane methyleneoxyacetic acid, $N(CH_3)CSN(CH_3)$, $(CH_2OCH_2CH_2SeCH_2CH_2COOH)_2$,

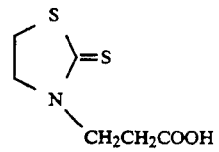

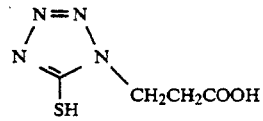

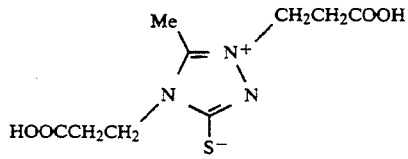

-continued

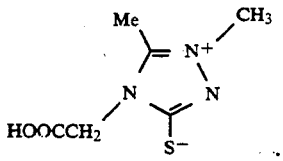

12. A process according to claim 1, wherein said salt is a magnesium salt or a calcium salt.

13. A process according to claim 12, wherein said salt is a nitrate, a perchlorate, or an acetate.

14. A process according to claim 13, wherein said salt is calcium nitrate or magnesium nitrate.

15. A process according to claim 1 wherein the concentration of silver halide in said emulsion is from $10^{-3}$ to 2 mole/liter, the concentration of said ripening agent is from $10^{-4}$ to $10^{-2}$ mole/mole of silver halide, and the concentration of said salt is from 0.5 to 10 mole/mole of ripening agent.

16. A photosensitive silver halide emulsion prepared by the process of claim 1.

17. A photosensitive silver halide element comprising a support bearing the emulsion of claim 16.

18. A photosensitive silver halide emulsion prepared by the process of claim 11.

19. A photosensitive silver halide element comprising a support bearing the emulsion of claim 18.

* * * * *

IN THE UNITED STATES PATENT AND TRADEMARK OFFICE

CERTIFICATE OF CORRECTION

PATENT NO. : 5,246,825

DATED : September 21, 1993

INVENTOR(S) : Arthur H. Herz et al.

It is certified that errors appear in the above-identified patent and that said Letters Patent is hereby corrected as shown below:

Col 12, line 30, delete "said" and insert --- acid ---.

Col 12, line 48, delete "$N(CH_3)CSN(CH_3)$" and insert --- $[HOOC(CH_2)_3]N(CH_3)CSN(CH_3)[(CH_2)_3COOH]$ ---.

Signed and Sealed this

Eighteenth Day of October, 1994

*Attest:*

Bruce Lehman

BRUCE LEHMAN

*Attesting Officer*

*Commissioner of Patents and Trademarks*